United States Patent [19]

Sciuto

[11] Patent Number: 4,541,320

[45] Date of Patent: Sep. 17, 1985

[54] STRINGED INSTRUMENT SADDLE LOCK

[76] Inventor: Michael N. Sciuto, 503 Castle Dr., Apt. E, Baltimore, Md. 21212

[21] Appl. No.: 459,589

[22] Filed: Jan. 20, 1983

[51] Int. Cl.[4] ..... G10D 3/04

[52] U.S. Cl. ..... 84/298; 84/307

[58] Field of Search ..... 84/267, 298, 299, 305, 84/307, 312, 313

[56] References Cited

U.S. PATENT DOCUMENTS

| | | | |
|---|---|---|---|
| D. 256,804 | 9/1980 | Fender | D17/21 |
| 389,958 | 9/1888 | Fitch | 84/305 |
| 2,972,923 | 2/1961 | Fender | 84/313 |
| 3,178,985 | 4/1965 | Jeranson | 84/307 |
| 3,241,418 | 3/1966 | Fender | 84/313 |
| 3,290,980 | 12/1966 | Fender | 84/307 |
| 3,390,600 | 7/1968 | Kelley | 84/312 P |
| 3,427,916 | 2/1969 | Fender | 84/267 |
| 4,031,799 | 6/1977 | Fender | 84/307 |
| 4,248,126 | 2/1981 | Lieber | 84/299 |
| 4,281,576 | 8/1981 | Fender | 84/298 |
| 4,304,163 | 12/1981 | Siminoff | 84/314 N |

OTHER PUBLICATIONS

Advertisement, "The G & L L-2000-E Bass," G & L Music Sales, Inc., *Guitar Player* (Apr. 1981).

*Primary Examiner*—Lawrence R. Franklin

*Attorney, Agent, or Firm*—Saidman, Sterne, Kessler & Goldstein

[57] ABSTRACT

A stringed instrument includes a bridge having drums over which strings pass that are equipped with locking members to prevent unwanted string vibrations and shifts in a string's octave point that normally result from the loosening of the harmonic and height adjustment screws of the drums.

16 Claims, 4 Drawing Figures

FIG. 2
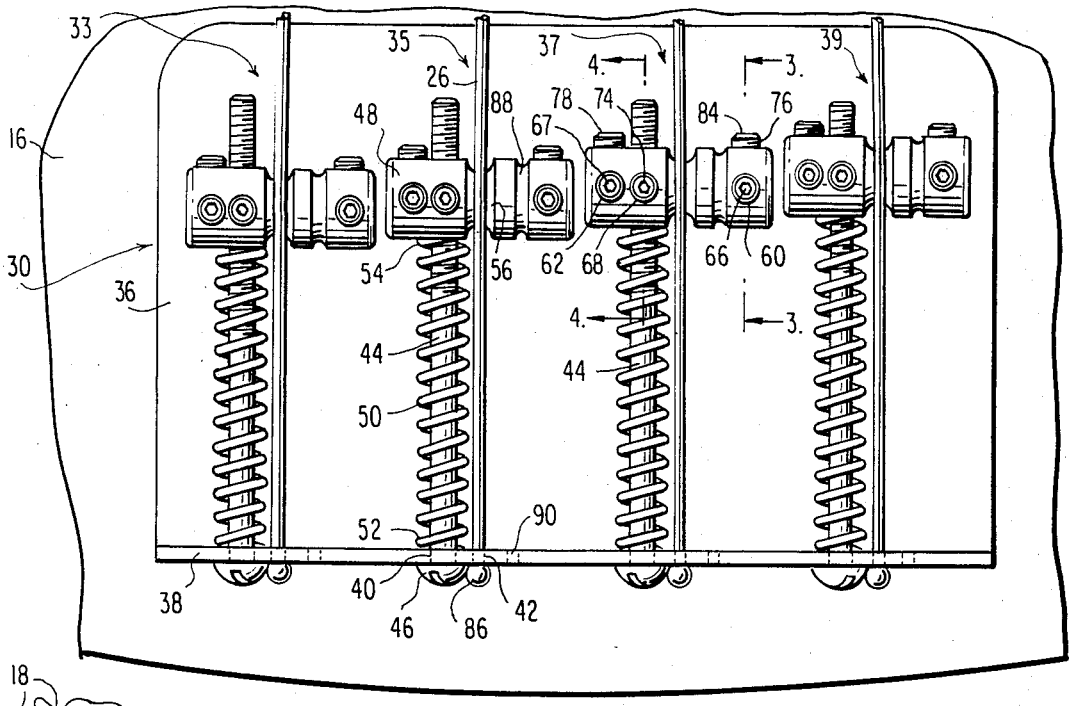
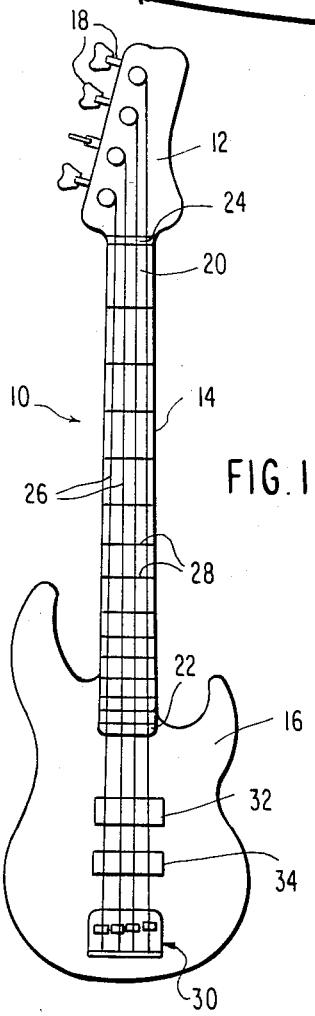
FIG. 1
FIG. 3
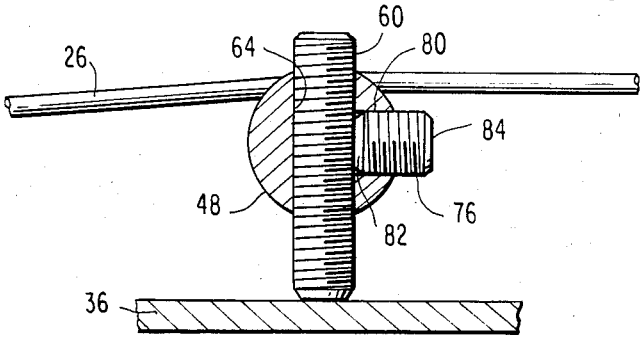
FIG. 4
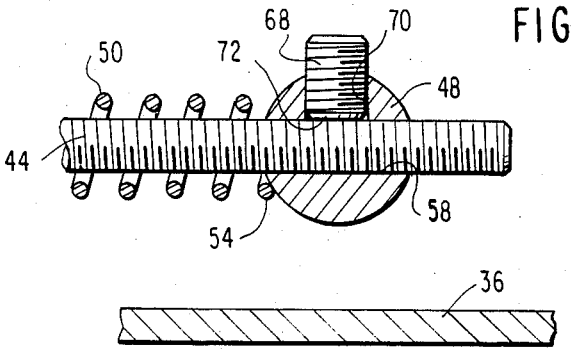

STRINGED INSTRUMENT SADDLE LOCK

BACKGROUND OF THE INVENTION

1. Field of the Invention

The present invention is related to stringed instruments, and more particularly, is directed towards bridge mechanisms utilized with stringed instruments.

2. Description of the Related Art

In order for a stringed instrument to be in tune, the octave point of each string must be aligned with its corresponding octave fret. The frets are located, for example, on the neck of an electric guitar or bass. The octave point of a string is defined by the overall resonant length of the string which is, in turn, defined by the distance between the contact point of the string at the nut and the contact point of the string at the bridge. The string does not vibrate acoustically beyond these two contact points. As long as the distance between the contact points at the nut and the bridge remains constant, the resonant length of the string, and therefore its octave point, also remains constant.

In modern electric guitars, for example, it is also recognized that the height of each string relative to the neck of the instrument is a matter of personal taste, and many mechanisms have been introduced to permit the height of individual strings to be varied. See, for example, U.S. Pat. No. 4,031,799 to Fender. This height adjustment is generally achieved by varying the spacing between the bridge and the body of the instrument by means of, for example, height adjustment screws that extend vertically through individual bridge sections, known as drums, over which the strings pass. Bridges conventionally may comprise a plurality of drums that are positioned in an end-to-end relationship; each typically having an upper groove, or saddle, to accommodate one string per drum. The contact point of a string at the bridge is where the string contacts its saddle.

However, it is also known that adjusting the height of a drum undesirably changes the length of its string, which, as stated above, changes the location of the string's octave point. It has therefore been recognized that in order to maintain the string in proper tune, it is necessary to simultaneously adjust the longitudinal position of the drum (and hence the contact point of the associated string) when height adjustments are made. A harmonic adjustment screw permits longitudinal movement of the drum (and saddle) to adjust string length and thus octave alignment. See, for example, U.S. Pat. Nos. 2,972,923; 3,290,980; and 3,427,916.

While the bridges described above do provide the necessary degree of individual adjustment for the strings, they result in certain disadvantageous effects. Specifically, because separate bridge components are present, rather than a unitary solid bridge, lateral vibration or movement of the drums results from string vibrations. The tone-sustaining capability of a given string is related to the inflexibility of the contact points at which the string is coupled to the instrument, that is, the nut and the saddle. If the drums vibrate at their string contact points, this vibration detrimentally reduces the tone-sustaining capability of the string. This drum vibrational movement further may cause the height and length adjustment screws to rotate within the drums as well, thereby altering the harmonic adjustment of the strings. This necessitates continuous and inconvenient readjustments.

One device to reduce drum vibration is disclosed in U.S. Pat. No. 4,031,799. The device consists of a bridge with a plurality of drums in which the strings also contact the harmonic adjustment screws coupling the drums to the base member of the bridge. Such an assembly was found to be inconvenient in practice by its inventor, according to his subsequent U.S. Pat. No. 4,281,576. Both of these patents also teach bringing the strings into engagement with the drums so as to force them into end-to-end contact, ultimately forcing the several drums against a fixed abutment on the bridge. See also U.S. Pat. No. 3,178,985. While all of these devices do reduce lateral drum vibration, they disadvantageously require the purchase and installation of an entire new bridge assembly. A further disadvantage is that the tension on all drums must be released prior to adjusting individual drums.

Vibrations of the height adjustment screws of conventional drums disadvantageously lowers them towards the bridge's base, thereby decreasing the height of strings above the neck.

No device is known that locks a stringed instrument's drums into a vibrationless mode, while simultaneously permitting the several drums to be independently adjusted.

SUMMARY OF THE INVENTION

The bridge of this invention comprises a plate, with a perpendicular flange, that is coupled to the body of a stringed instrument. The bridge has at least one drum with a horizontally threaded bore, and an elongated harmonic adjustment screw that extends through the flange into the horizontally threaded bore. One or more height adjustment screws threadably extend through vertically threaded bore(s) in the drum to contact the plate of the bridge assembly. Means for separately and independently preventing rotation of the harmonic adjustment screw and the height adjustment screw(s), respectively, are preferably embodied by threaded set screws.

The set (or locking) screws of this invention threadably extend through horizontally and vertically threaded bores in the drum that intersect the horizontally threaded bore through which the harmonic adjustment screw extends and the vertically threaded bore(s) through which the height adjustment screw(s) extend, respectively. In a preferred embodiment, the set screws include a resilient tip, such as of plastic or nylon, at their ends that abut the harmonic adjustment or height adjustment screw(s). The set screws when tightened prevent the harmonic and height adjustment screws from changing position by preventing rotation within the drums, as would otherwise be caused by vibration of the strings that pass over the drums. This locking action fixes the drums in place and thereby increases the tonality of the instrument, as well as prevents the octave points of each string from drifting due to movement of the drum either longitudinally toward or away from the flange due to loosening of the harmonic adjustment screw or vertically through loosening of the height adjustment screws.

BRIEF DESCRIPTION OF THE DRAWINGS

The foregoing and other objects, aspects, features and advantages of the present invention will be better understood from the following detailed description thereof when considered in conjunction with the accompanying drawings, in which:

FIG. 1 is a top plan view of an electric guitar;

FIG. 2 is an enlarged, top plan view of the guitar's bridge assembly;

FIG. 3 is a cross-sectional view taken along line 3—3 of FIG. 2 of a preferred embodiment of a height adjustment screw and locking mechanism according to the present invention; and FIG. 4 is a cross-sectional view taken along line 4—4 of FIG. 2 of a preferred embodiment of the harmonic adjustment screw and locking mechanism according to the present invention.

DESCRIPTION OF THE PREFERRED EMBODIMENTS

Referring now to the drawings, wherein like reference numerals represent identical or corresponding parts throughout the several views, and more particularly to FIG. 1, there is shown a stringed instrument, generally designated at 10, represented in this preferred embodiment by a four string electric bass guitar. The guitar 10 conventionally includes a head 12, a neck 14, and a body 16. Head 12 is fastened to one end 20 of neck 14 and body 16 is fastened to the other end 22 of neck 14. Head 12 includes four conventional tuning peg assemblies 18. A grooved nut 24 is fastened to neck 14 at the point where it meets head 12. Neck 14 also includes a plurality of frets 28 spaced along the length thereof which are equally elevated above the plane of neck 14.

Body 16 generally is aesthetically shaped and contoured to facilitate the playing of the instrument. Body 16 has a bridge generally indicated by reference numeral 30 which is mounted to the lower portion of the outer surface thereof.

Guitar 10 also includes a plurality of strings 26. Each string 26 is coupled at one of its ends to its individual tuning peg assembly 18 and at its other end to its individual element of the bridge 30. The structure of bridge 30 will be described in more detail hereinafter. Strings 26 pass over nut 24, which has a separate groove (not shown) for each string 26. Nut 24 serves as the first contact point for the strings, and bridge 30 serves as the second contact point for the strings. Frets 28 are smooth and lack the grooves found in nut 24. Frets 28 serve as selectable contact points, in lieu of the fixed contact point at nut 24. A guitarist playing the instrument 10 shortens the effective acoustically vibrating length of a string 26 by pressing the string against neck 14 so that the string makes contact with one of the raised frets 28. This brings the string's contact points closer together, thereby increasing the string's pitch.

An electric guitar, such as shown here, typically carries two conventional electric pick-ups 32 and 34 on body 16 that function in a manner similar to microphones and convert vibrations of the strings into electrical signals capable of amplification or broadcast.

Now referring more particularly to FIG. 2, an enlarged view of the bridge 30 of the present invention is shown. Bridge 30 includes a substantially planar plate 36 that is mounted flush with the outer surface of body 16. A narrow flange portion 38 extends substantially perpendicularly to plate 36 at the lower end thereof outwardly from body 16. Plate 36 may be fastened to body 16 by, for example, a plurality of screws (not shown), or other conventional means.

As indicated in FIG. 2, bridge 30 of the present invention has a plurality of separate, substantially identical string-receiving assemblies 33, 35, 37 and 39. The assemblies 33–39 are substantially identical in construction and use. Each assembly 33–39 conventionally has the following major elements: a harmonic adjustment screw 44, a spring 50, a drum 48, two height adjustment screws 60 and 62, and a string 26.

Flange 38 of bridge assembly 30 has a bore 40 and an adjacent smaller bore 42 (both shown in phantom). Harmonic adjustment screw 44 is elongated and passes through bore 40; the head 46 of screw 44 is retained by flange 38. String 26 passes through bore 42 to be retained behind flange 38 by means of a beaded end 86.

Harmonic adjustment screw 44 is threadably coupled at its other end to drum 48. Spring 50 surrounds screw 44 and is fixed between flange 38 and drum 48, with a first end 52 that abuts flange 38 and a second end 54 that abuts drum 48. Spring 50 exerts a force that biases the flange and drum apart, thereby ensuring that head 46 of harmonic adjustment screw 44 remains in contact with flange 38. Drum 48 also has a longitudinal groove or saddle 56 to receive string 26. Saddle 56 serves as a fixed contact point for the string.

Referring now to FIGS. 2, 3 and 4, drum 48 bears a plurality of threaded bores. Referring most particularly to FIGS. 2 and 4, drum 48 has a horizontally threaded bore 58 through which the shaft of harmonic adjustment screw 44 extends. Rotation of harmonic adjustment screw 44 relative to drum 48 moves drum 48 longitudinally either towards or away from flange 38 of bridge 30, thereby altering the length of string 26 between its contact point at nut 24 and its contact point on drum 48 in saddle 56.

Referring to FIGS. 2 and 3, drum 48 has a vertically threaded bore 64 that does not intersect horizontally threaded bore 58. Vertically threaded bore 64 receives height adjustment screw 60 that extends through drum 48 to contact plate 36. An analogous vertically threaded bore (not shown) receives height adjustment screw 62 and is adjacent to but does not intersect bore 58. As illustrated in this embodiment of the present invention, the upper, exposed ends of screws 60 and 62 conventionally have a recessed portion forming Allen nut receptacles 66 and 67, respectively, to engage a conventional Allen wrench for rotational driving. It should be apparent that other types of screws, such as Phillips head screws, may alternatively be used.

The positions of the two height adjustment screws 60 and 62 with respect to drum 48 through which they pass, determine the height between drum 48 and plate 36. Thus, the height of string 26 above neck 14 is determined by the height of its drum 48 above plate 36. An Allen wrench may rotate the screw 60 (or 62) in either direction to raise or lower drum 48 with respect to bridge 30, respectively. As seen in FIG. 2, drums 48 do not make contact with each other in order to facilitate individual freedom of movement of the drums for adjustment purposes.

The saddle lock of the present invention is shown, in part, in FIGS. 2 and 4. Drum 48 has a vertically threaded bore 70 that intersects bore 58. A harmonic locking (or set) screw 68 extends through bore 70 to intersect the shaft of harmonic adjustment screw 44. The internal end 72 of set screw 68 abuts the shaft of harmonic adjustment screw 44 thereby locking it in place and preventing its rotation within drum 48 that would otherwise be caused by vibration of string 26 as instrument 10 is played. End 72 of set screw 68 may bear, for example, a plastic or nylon tip. Such a resilient tip firmly holds the harmonic adjustment screw in place but does not strip or score its threads. Set screw 68 conventionally includes an Allen nut receptacle 74 at its upper end, as seen in FIG. 2.

The saddle lock of the present invention is further illustrated in FIGS. 2 and 3. Height locking (or set) screws 76 and 78 are shown in FIG. 2, and FIG. 3 is a sectional view through set screw 76. Although a similar view of set screw 78 is not shown, its installation and use are substantially identical to that shown and described in FIG. 3 for set screw 76. Drum 48 has a horizontally threaded bore 80 that intersects bore 64. Set screw 76 extends through bore 80 to intersect height adjustment screw 60. The internal end 82 of set screw 76 abuts the shaft of height adjustment screw 60 thereby locking it in place and preventing its rotation within drum 48 that would otherwise be caused by vibration of string 26 as instrument 10 is played. The other end 84 of set screw 76 conveniently has a recessed Allen nut receptacle (not shown) to receive an Allen wrench. The end 82 of set screw 76 may also bear a plastic or nylon tip to firmly hold the screw 60 in place without stripping or scoring its threads.

In the embodiment shown in FIG. 2, a second longitudinal saddle 88 is disposed adjacent to saddle 56. Thus, drum 48 of instrument 10 is adapted to optionally receive a second string for purposes of converting this instrument into a double-stringed guitar. In such a double-stringed embodiment, a second set of strings would pass over saddles 88 in each drum 48 and pass through another bore 90 (shown in phantom) in flange 38 and terminate with a beaded end as does string 26.

In use, after the height of strings 26 above neck 14 and bridge 30 have been adjusted to suit personal tastes of the instrument's player, the proper octave point of a string may be adjusted by utilizing harmonic adjustment screw 44. When appropriate adjustment has been made, harmonic locking set screw 68 as well as height locking set screws 76 and 78 are tightened, thereby preventing loosening of the harmonic adjustment screw or the height adjustment screws or movements of drums 48 caused by vibrations of the strings while instrument 10 is being played.

While the invention has been described with respect to the preferred embodiment shown herein, it will be apparent to those skilled in the art that various modifications and improvements may be made without departing from the scope and spirit of the invention. Accordingly, it is to be understood that the invention is not to be limited by the specific illustrative embodiment but only by the scope of the appended claims.

What is claimed is:

1. A bridge for a stringed instrument, comprising:

a plate;

a flange substantially perpendicular to said plate;

means for coupling said plate to the stringed instrument;

at least one drum adjustably mounted on said plate, said drum having a horizontally threaded bore;

an elongated harmonic adjustment screw extending through said flange and said horizontally threaded bore; and set screw means for preventing rotation of said harmonic adjustment screw.

2. A bridge for a musical instrument having a body, a neck and a plurality of strings, comprising:

a plate rigidly connectable to the body of the instrument;

flange means extending outwardly from said plate for terminating one end of the strings therein;

a first drum positioned on said plate and spaced from said flange, one of the plurality of strings being contactingly extendable over said drum, said drum having a first horizontally threaded bore and a first vertically threaded bore;

an elongated harmonic adjustment screw extending through said flange and said first horizontally threaded bore of said drum for permitting adjustment of the resonant length of the string;

a first height adjustment screw extending through said first vertically threaded bore of said drum and contacting said plate for permitting adjustment of the height of the string above the body and neck; and set screw means in said drum for preventing rotation of said harmonic adjustment screw and said height adjustment screw.

3. A bridge as recited in claim 2, further comprising a plurality of drums in end-to-end orientation across said plate wherein each of said drums is substantially identical to said first drum.

4. A bridge for a stringed instrument, comprising:

a plate;

a flange substantially perpendicular to said plate; means for coupling said plate to the stringed instrument;

at least one drum adjustably mounted on said plate, said drum having a first horizontally threaded bore and a first vertically threaded bore that does not intersect said first horizontally threaded bore;

an elongated harmonic adjustment screw extending through said flange and said first horizontally threaded bore;

a first height adjustment screw extending through said first vertically threaded bore and contacting said plate; and set screw means for preventing rotation of at least one of said harmonic or height adjustment screws.

5. The bridge of claim 1, wherein said drum further comprises:

a second vertically threaded bore that intersects said first horizontally threaded bore; and a second horizontally threaded bore that intersects said first vertically threaded bore.

6. The bridge of claim 5, wherein said set screw means comprises a first set screw that extends through said second vertically threaded bore to abut said harmonic adjustment screw thereby preventing its rotation.

7. The bridge of claim 6, wherein said set screw means further comprises a second set screw that extends through said second horizontally threaded bore to abut said first height adjustment screw thereby preventing its rotation.

8. The bridge of claim 7, wherein said first and second set screws further comprise a resilient portion at one end thereof that makes contact with said harmonic adjustment screw and said first height adjustment screw, respectively.

9. The bridge of claim 7, wherein said drum further comprises a third vertically threaded bore that does not intersect said first horizontally threaded bore and a third horizontally threaded bore that intersects said third vertically threaded bore.

10. The bridge of claim 9, further comprising a second height adjustment screw extending through said third vertically threaded bore and contacting said plate.

11. The bridge of claim 10, further comprising a third set screw that extends through said third horizontally threaded bore to abut said second height adjustment screw thereby preventing its rotation.

12. The bridge of claim 11, further comprising a plurality of drums substantially identical to said at least one drum and arranged side by side across said plate.

13. The bridge of claim 1, further comprising a plurality of drums substantially identical to said at least one drum and arranged side by side across said plate.

14. A bridge for a stringed instrument having a body, comprising:

a plate;

a flange portion substantially perpendicular to said plate;

means for coupling said plate to the body;

at least one drum having a first end, a second end and a first horizontally threaded bore extending through said drum approximately adjacent said first end;

a first vertically threaded bore extending through said drum approximately at said first end;

a second vertically threaded bore extending through said drum approximately at said second end;

a third vertically threaded bore formed in said drum and intersecting said first horizontally threaded bore;

a second horizontally threaded bore formed in said first end and intersecting said first vertically threaded bore;

a third horizontally threaded bore formed in said second end and intersecting said second vertically threaded bore;

a string that passes over said drum;

means for terminating said string in the vicinity of said flange;

an elongated harmonic adjustment screw threadably extending through said first horizontally threaded bore and passing through said flange to couple said flange and said drum;

a spring located between said flange and said drum through which said harmonic adjustment screw extends to bias said drum away from said flange;

a first height adjustment screw threadably extending through said first vertically threaded bore to contact said plate;

a second height adjustment screw threadably extending through said second vertically threaded bore to contact said plate;

a first set screw threadably extending through said third vertically threaded bore to abut said harmonic adjustment screw thereby preventing its rotation;

a second set screw threadably extending through said second horizontally threaded bore to abut said first height adjustment screw thereby preventing its rotation;

a third set screw threadably extending through said third horizontally threaded bore to abut said second height adjustment screw thereby preventing its rotation; and said drum having a first groove to receive said string and a second groove adapted to receive a second string adjacent to said first string.

15. The bridge of claim 14, further comprising a plurality of drums substantially identical to said at least one drum and arranged side by side across said plate.

16. A bridge for a stringed instrument, comprising:

a plate;

means for coupling said plate to the stringed instrument;

at least one drum adjustably mounted on said plate, said drum having a vertically threaded bore;

a height adjustment screw extending through said vertically threaded bore and contacting said plate; and set screw means for preventing rotation of said height adjustment screw.

* * * * *